US007171772B1

(12) United States Patent
Male

(10) Patent No.: US 7,171,772 B1
(45) Date of Patent: Feb. 6, 2007

(54) EARTH RHYTHM LIGHT REFLECTOR

(75) Inventor: Cynthia Lee Male, P.O. Box 5181, Kingshill, St. Croix, VI (US) 00851

(73) Assignee: Cynthia Lee Male, St. Croix, VI (US)

( * ) Notice: Subject to any disclaimer, the term of this patent is extended or adjusted under 35 U.S.C. 154(b) by 0 days.

(21) Appl. No.: 11/243,357

(22) Filed: Oct. 4, 2005

(51) Int. Cl.
*G09F 13/00* (2006.01)

(52) U.S. Cl. ..... 40/541; 40/716; 40/738; 40/773

(58) Field of Classification Search ..... 40/559, 40/541, 716, 737, 1, 554, 738, 743, 773; 362/161; D26/11, 23, 6
See application file for complete search history.

(56) References Cited

U.S. PATENT DOCUMENTS

| | | | | | |
|---|---|---|---|---|---|
| 1,585,765 | A * | 5/1926 | Chitra | 428/29 |
| 3,286,492 | A * | 11/1966 | Frazier, Jr. | 40/541 |
| 3,451,877 | A * | 6/1969 | Herschman | 428/38 |
| 3,456,106 | A * | 7/1969 | Gluschkin | 362/98 |
| 4,068,120 | A * | 1/1978 | Throckmorton et al. | 362/351 |
| 4,163,333 | A * | 8/1979 | Kwiatkowski | 40/561 |
| 4,196,535 | A * | 4/1980 | Heimo | 40/738 |
| 4,809,145 | A * | 2/1989 | Bennett | 362/358 |
| 5,115,385 | A * | 5/1992 | Jeckle | 362/358 |
| 5,191,214 | A * | 3/1993 | Hiranami | 250/316.1 |
| 5,264,995 | A * | 11/1993 | McKee | 362/161 |
| 5,413,870 | A * | 5/1995 | Flood | 428/542.2 |
| 5,654,552 | A * | 8/1997 | Toombs | 250/462.1 |
| D421,656 | S * | 3/2000 | Batterman-Jordan | D26/10 |
| 6,502,339 | B1 * | 1/2003 | Shapiro | 40/560 |
| 6,554,447 | B1 * | 4/2003 | Kotary et al. | 362/161 |
| 6,595,665 | B1 * | 7/2003 | Park | 362/449 |
| 6,663,143 | B2 * | 12/2003 | Zirker | 283/81 |
| 2003/0231488 | A1 * | 12/2003 | Albee | 362/96 |

* cited by examiner

*Primary Examiner*—Gary C. Hoge

(57) ABSTRACT

The present reflector is an acrylic screen or curtain created for the purpose of illuminating designs and images by candlelight. The reflector is a free standing, thermo-molded, light-weight, acrylic form with decorative fabric affixed to the convex side of the form to be used in conjunction with a candle placed within the concave area of the form for illuminating the fabric images and softening the light from the candle. The concave side of the form, not covered with the fabric, reflects the light in such a way as to give the appearance of a flame levitating in the air, as if a hologram, above the actual candle. The designs are printed on a synthetic poly silk fabric using dye sublimation process and may easily be cleaned with a damp sponge or cloth. The. curved acrylic form is edged with copper foiling for a decorative finish that will patina over time.

4 Claims, 1 Drawing Sheet

EARTH RHYTHM LIGHT REFLECTOR

BACKGROUND OF THE INVENTION

Figure 1:
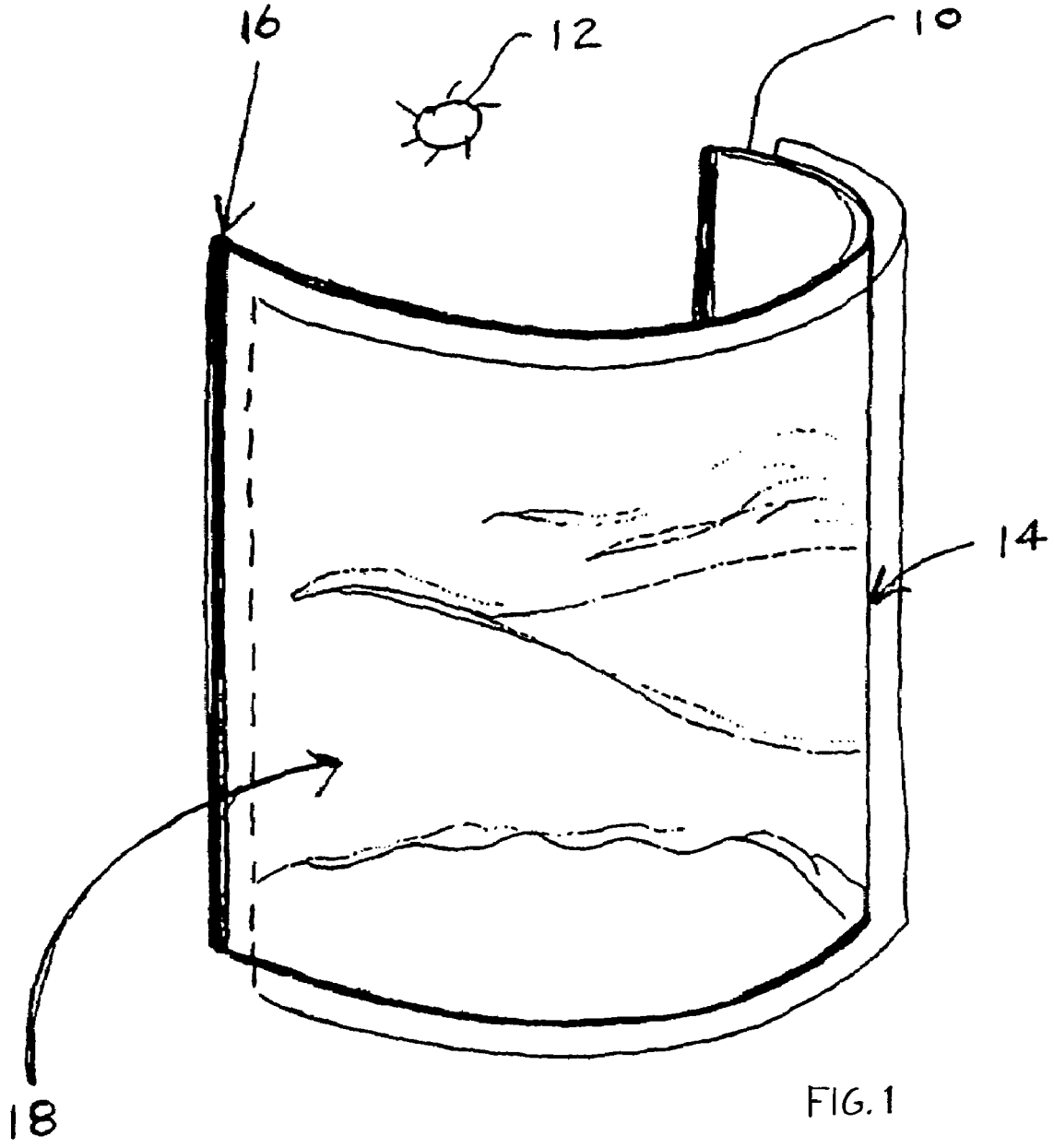

The present invention relates to a light unit and, more particularly, to a free-standing unit that provides a transparent canvas for artwork illuminated by an illumination source.

There have been attempts in the past to produce a device that could be used with a source of light such as a candle, in order to present a pleasant, aesthetic appearance to the user. Such devices are intended to provide some pattern on a substrate, such as glass, and are generally positioned so that the illumination from the source of light passes through the device in order to provide a unique pattern of light. In general, however, these devices tended to be in the form of a shade for a lamp and/or were not free standing. They tended to be heavy in appearance and not light in weight or transparent. In addition, such prior devices were normally hand painted, labor intensive, expensive to produce and therefore unsuitable for low end marketing of the devices. The light device of the present invention is printed, making it a perfect low end accessory.

It would, therefore, be advantageous to have a light unit sculptural, free standing, and having been illuminated by means of a light source and which can provide a variety of ethereal fine art images for the user and which are robust and produce esthetically pleasing, unique patterns for the user and yet which are on a device that is produced relatively inexpensively for commercial production.

SUMMARY OF THE INVENTION

The light reflector of the present invention therefore overcomes the difficulties and problems of the prior art devices by providing a non-breakable, transparent, easy to clean light device that is readily stackable for shipping. This device is an affordable alternative to stained and hand painted glass. It is an elegant and unencumbered structural alternative to traditional lampshades and candleholders.

The present device represents the Japanese aesthetic principles of wabi sabi. Quite simply, Lexan or Plexiglas acrylic is heated to around 325 degrees F. in a regular conventional oven for approximately three (3) minutes. The acrylic is removed from the oven and placed so that it covers half way around a cylindrically formed object. The designs adorning the previously discussed forms are scanned or photographed original art that has been digitally re-worked, often re-colored, manipulated, and cleaned of random pixels. The resulting patterns are synthesized into one large image to be digitally printed out in yardage using the sub dye process. There are many such printing companies that can carry out such printing. The final image is stored on a computer readable medium, such as a CD or DVD and the printer prints the image. Those images are cut into individual sections from the singular yardage and affixed onto the thermo-molded forms with a spray adhesive. One adhesive that is suitable for the affixing step is current available from the 3M Company. The final step to this process is trimming the finished pieces with scissors and adding the copper foiling.

BRIEF DESCRIPTIONS OF THE DRAWINGS

The Figure is a schematic view illustrating the invention and further illustrating the various materials utilized for the production thereof.

DETAILED DESCRIPTION OF A PREFERRED EMBODIMENT

Turning to the Figure, there is shown a schematic view of the present invention. As can be seen, the invention comprises a curved form 10 that, as shown, is preferably in the form of a semi-cylindrical configuration, that is, the edge profile is a semi-circle. Other curved configurations can, of course, be used with the present invention as will become apparent. The curved form 10 is preferably comprised of an acrylic plastic material such as Lexan or Plexiglas acrylic and can be produced by heating a flat sheet of the material in a conventional oven to around 325 degrees F. for approximately three (3) minutes. The heated acrylic is then removed from the oven and placed so that it covers half way around a cylindrically formed object.

There is also a light source 12 located in a position with respect to the curved form 10 so as to provide illumination to impinge upon the curved form 10. As can be seen, the location of the light source 12 is such as to provide the light to hit the concave side of the curved form 10 so that the light passing through the curved form 10 emanates outwardly from the convex side.

In accordance with a preferred embodiment of the present invention, the curved form 10 is a thermo-molded acrylic, such as Plexiglas, and there is a sub dye printed poly silk fabric 14 applied to the concave side of the curved form 10. In the exemplary embodiment the silk fabric 14 is adhered to the convex side of the curved form 10 by means of an adhesive such as a spray adhesive commercially available from the 3M Company. A copper foil tape 16 is applied to the exterior perimeter of the curved form 10. In an embodiment, the dimensions of the overall curved form 10 are either 6"×8" or 9"×12".

There is an image 18 on the silk fabric 14 and which can be produced in accordance with the present invention. In particular, the image can be an original work created by hand painting, batik, color pencil, or Lexan painted mural designs. The present device represents the Japanese aesthetic principles of wabi sabi.

The original work is then digitized by scanning or by means of a digital photograph and can be digitally reworked, so as to re-colored, manipulate, and clean the random pixels. The resulting patterns are synthesized into one large image to be digitally printed out in yardage using the sub dye process. There are many such printing companies that can carry out such printing.

The final image is stored on a computer readable medium, such as a CD or DVD and the printer prints the image onto the silk material. Those images are cut into individual sections from the singular yardage and affixed, as described, onto the curved form 10 with a spray adhesive. The final step to this process is trimming the finished pieces with scissors and adding the copper foil tape 16 around the periphery of the curved form 10.

Additional modifications and improvements of the present invention may also be apparent. The particular embodiment illustrated herein is intended to represent only one embodiment of the invention, and is not intended to serve as limitations of alternative devices within the spirit and scope of the invention.

What is claimed is:

1. A freestanding decorative unit comprising a curved, transparent acrylic form in the shape of a segment of a cylinder and adapted to receive light from a source of light, said curved form having a concave side facing a source of light and a convex side, a fabric adhesively adhered to the convex side of the curved form, the fabric having a decorative work printed thereon wherein light from a source of light passes through the transparent, curved form and the decorative work.

2. The unit of claim 1 wherein the decorative work is an original work printed thereon.

3. The unit of claim 1 wherein the fabric is a silk fabric.

4. The unit of claim 1 wherein the curved form is a semi-cylindrical configuration.

* * * * *